United States Patent [19]

Botros

[11] 4,436,966

[45] Mar. 13, 1984

[54] CONFERENCE MICROPHONE UNIT

[75] Inventor: Radamis Botros, Nepean, Canada

[73] Assignee: Darome, Inc., Harvard, Ill.

[21] Appl. No.: 358,293

[22] Filed: Mar. 15, 1982

[51] Int. Cl.[3] ..... H04R 19/04; H04R 1/32

[52] U.S. Cl. ..... 179/121 D; 179/105; 179/111 E; 179/138; 181/157; 181/158; 181/175

[58] Field of Search ..... 179/121 D, 100 L, 111 E, 179/1 MF, 1 DM, 1 FS, 105, 139, 138, 156 R, 107 FD; 181/157, 158, 138, 175

[56] References Cited

U.S. PATENT DOCUMENTS 2,385,279 9/1945 Hopkins ..... 179/81 B
3,573,399 8/1968 Schroeder et al. ..... 179/121
4,237,339 12/1980 Bunting et al. ..... 179/1 CN
4,258,719 5/1981 Manger ..... 179/1 E

OTHER PUBLICATIONS

R. Botros, "Audio Teleconferencing–The Telephone and the Environment", Telesis, Feb. 1977, pp. 16–21.

*Primary Examiner*—G. Z. Rubinson
*Assistant Examiner*—Danita R. Byrd
*Attorney, Agent, or Firm*—Spencer & Frank

[57] ABSTRACT

A microphone unit particularly suitable for conference applications is provided, wherein an acousto-electric transducer is disposed between two dish-like back-to-back sound collectors, each having a central aperture exposing one side of the transducer, which preferably has a single planar diaphragm.

9 Claims, 9 Drawing Figures

CONFERENCE MICROPHONE UNIT

FIELD OF THE INVENTION

The present invention relates to microphones in general and to directional microphones in particular. More particularly, the invention relates to a microphone unit, which is capable of being combined with other such units, and with acoustic radiators, for conference applications.

BACKGROUND AND PRIOR ART

An electro-acoustic microphone having a single planar diaphragm in a free field exhibits a null-response in the plane of its diaphragm, while having its maximum response along its perpendicular axis of symmetry. Such an ideal device is called a "cosine microphone". At any point between the axis and the plane of the diaphragm, the response is proportional to the cosine of the angle, say $\theta$, that the point is at w.r.t. the axis-centre. The reason for a response null in the plane of the diaphragm, of course, is that sound pressure impinges equally on either side thereof in opposite directions, thereby not causing movement of the diaphragm, given perfect symmetry in a free field. Practical microphones have relatively small diaphragms. Even sound pressure emanating from a point of maximum response far along the axis is bound to also reach the other side of the diaphragm with some phase shift and thereby cause some cancellation in the response.

It is desirable in many applications to have good cancellation in the plane of the diaphragm, yet to maintain high sensitivity on either side thereof, particularly in the vicinity of the axis. Such desirable characteristics would result in a conference apparatus having a reduced degree of voice switching, thereby enabling more natural two-way communication betweeen two or more parties of conferees. It is also desirable to have a frequency response that is relatively independant of source position (this means quality of response is independent of the talker's position).

U.S. Pat. No. 4,237,339 issued Dec. 2, 1980 to Bunting et al and assigned to The Post Office, London, England is an example of the use to which such bidirectional microphones are put for purposes of audio teleconferencing. The patent discloses an electro-acoustic terminal unit for use in an audio teleconferencing system comprising a loudspeaker and one or more microphones each having a sensitivity which is directionally dependent and exhibits at least one null or substantially null position. The loudspeaker and microphones are rigidly mounted on a boom and the microphones are so located and orientated relative to the loudspeaker that the null position is directed towards the loudspeaker.

In FIG. 3 of the above patent to Bunting et al, two "shallow" voice switches (35 and 44) are used in order to eliminate undesirable feedback between the loudspeaker 10 and the microphones 12 and 14. The permitted degree of "shallowness" of the voice switching is clearly dependent on the degree of isolation provided by the microphone.

It is possible to utilize complicated microphones to provide acceptable isolation. For instance, U.S. Pat. No. 3,573,399 issued Apr. 6, 1971 to Schroeder et al and assigned to Bell Telephone Laboratories, Incorporated, N.J., U.S.A. discloses the structure of a microphone having toroidal characteristics. The microphone is constructed from a plurality of concentric transducer elements, the outputs of which are combined in accordance with a predetermined formula.

It is, therefore, generally recognized in the field of teleconferencing as desirable to have microphones of sufficient sensitivity to pick-up distance talkers and conferees, while simultaneously providing good directionality to lessen pick-up of background noise and reverberation and to prevent feedback with a minimum of voice switching.

SUMMARY OF THE INVENTION

The object of the present invention is to provide a simple, inexpensive microphone unit which exhibits good sensitivity and directionality.

The acousto-electric transducer necessary for the present unit can be a simple bi-directional transducer having a single planar diaphragm, such as the now ubiquitous electret transducers.

The transducer is placed at the junction of two dish-like sound collectors, which are back-to-back with their convex sides. An opening in each dish exposes the diaphragm to its concave side. The total structure exhibits rotational symmetry along the axis perpendicular to the centre of the transducer. And whether the two collectors actually touch or not, is not or primary importance. Indeed, the exact shape of the collectors does not appear to greatly alter the unit characteristics. For instance, a collector may be part of a sphere. Ot it may be parabolic.

Due to the symmetry of the total unit, the two identical back-to-back collectors do not interfere with the signal cancellation effect inherent in the cosine transducer in the plane of its diaphragm. But the collectors perform an important function along the axis of maximum response. For they reduce the cancellation effect for a second source at a far point on the axis: the collector facing the source enhances the sound pressure on its side, while the other collector provides a sound "shadow" to the other side, thereby improving the transducer output. This improvement directly means increased acoustic isolation or directionality, achieved with a single structure and a single element transducer.

Thus, the sensitivity of the microphone of the present invention is proportional to collector size, whereas its directionality is practically independent thereof, meaning that the frequency response, i.e. the variation of output with frequency or wavelength, is independent of collector size. Such independence of directionality from frequency response translates into better quality independent of talker position. This is of some importance in conferencing and conference telephony.

Accordingly, the present invention provides a microphone unit comprising a bidirectional acousto-electric transducer disposed in proximity to, and between, two dish-like back-to-back sound collectors each having an aperture therein exposing one of two active, opposite surfaces of said acousto-electric transducer, whereby said microphone unit exhibits substantially rotational symmetry around a central axis of bidirectionality.

More narrowly, the acousto-electric transducer is of the cosine response type.

More narrowly still, each of the two opposite surfaces of the transducer is within a substantially coextensive aperture in the respective collector.

In a preferred embodiment the transducer is an electret microphone.

In another preferred embodiment, two microphone units are positioned one above the other, having their axes of bidirectionality at a right angle, thereby yielding a quasi-toroidal directionality pattern.

BRIEF DESCRIPTION OF THE DRAWINGS

The present invention will be better understood in describing the preferred embodiments in conjunction with attached drawings, in which.

DETAILED DESCRIPTION OF THE PREFERRED EMBODIMENTS

Figure 1:
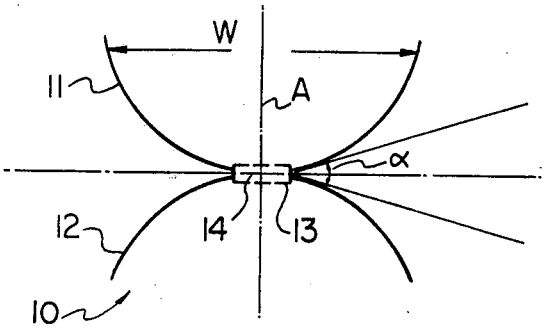
FIG. 1 schematically illustrates a microphone unit according to the present invention.

FIG. 1 of the drawings shows a basic microphone unit 10 of the present invention. The unit 10 comprises two dish-like collectors 11 and 12, each having a surface of an electret transducer 13 exposed through a cooperating aperture therein. Ideally, the outside surfaces of the transducer 13 are each coplanar with the inside surface of the respective collector 11 and 12. Shown schematically is the diaphragm 14 of the transducer 13, the plane of which is perpendicular to the plane of the drawing and is the null-plane, or plane of minimum sensitivity, of the total unit 10. Axis A is the axis of maximum sensitivity, the sensitivity or response of the unit 10 declining with the decrease in the angle with the plane of the diaphragm 14. Thus, for practical purposes a rotational angle $\alpha$ defines a dead-zone of the microphone unit 10. The angle $\alpha$ is in the vicinity of thirty degrees, and the response on the surface of the dead-zone is an an average of $-14$dB from the maximum response along the axis A by a collector width W of five inches. The average response of $-14$dB does not vary appreciably with frequency, and remains within $\pm 1$ dB from 300 Hz to 3,000 Hz. Such frequency range is approximately the standard bandwidth of a telephone channel. The collectors 11 and 12 may be made of a wide choice of materials such as plastic, plexiglass, metal and the like, and the transducer 13 is simply glued to the edges of the apertures in the collectors 11 and 12, which themselves are glued together at their junction by a compatible glue. Of course, other methods of assembly, such as riveting are possible.

Figure 2:
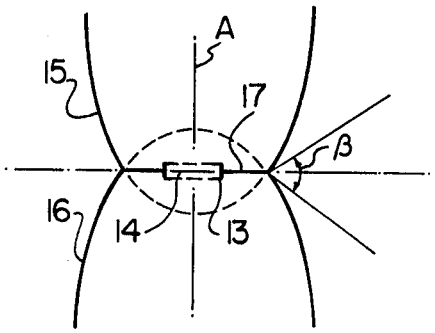
FIG. 2 schematically illustrates a microphone unit according to the present invention wherein truncated parapelic reflectors are utilized.

The collectors in FIG. 1 are shown to be spherical, or almost spherical. In FIG. 2, however, the collectors 15 and 16 are parabolic surfaces truncated some distance from the apex in order to permit placing of the transducer 13 at or close to the parabolic focus of both reflectors 15 and 16. A planar insert 17 closes the opening and accomodates the transducer 13 in a suitable aperture. The unit shown in FIG. 2 exhibits somewhat higher directionality so that the dead-zone angle $\beta$ is somewhat larger than the angle $\alpha$ in FIG. 1, given the same width W of the collectors 11, 12 and 15, 16. Both the microphone unit 10 and that of FIG. 2 are rotationally symmetrical with respect to the axis A.

Figure 3:
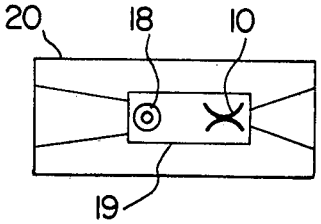
FIG. 3 shows a combined microphone unit and a loudspeaker for conference applications.

FIG. 3 shows a conference device comprising the microphone unit 10 and a loudspeaker 18 placed in a suitable enclosure 19 on a conference table 20. The loudspeaker 18 radiates upwardly, and the conference participants sit along the long sides of the table 20. In this arrangement no conference participants may sit along the narrow sides of the table 20, which are largely in the dead-zone.

Figure 4:
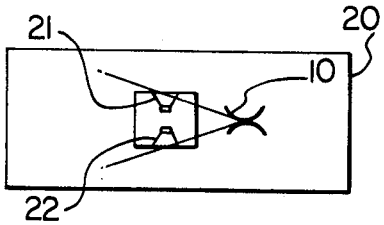
FIG. 4 shows a combined microphone unit and two loudspeakers for conference applications.

FIG. 4 shows a more preferred arrangement than that in FIG. 3, because two loudspeakers 21 and 22 are radiating one to either side of the conference table 20. In this arrangement it is mandatory that the loudspeakers be driven in-phase and be identical. Moreover, they must be positioned symmetrically on either side of the null-plane of the unit 10 within the dead-zone of the unit 10. This arrangement is preferred over the previous one, because of the higher "treble" content of the sound reaching the conference participants when the loudspeakers 21 and 22 are facing them.

Figure 5:
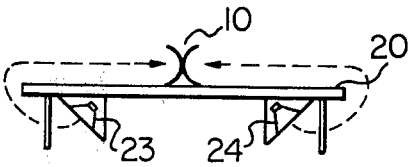
FIG. 5 shows an alternative arrangement using a microphone unit and two loudspeakers for conference applications.

In the embodiment of FIG. 5, the unit 10 is placed on the top of the conference table 20, while two loudspeakers, or loudspeaker rows, 23 and 24 are placed as shown under the table 20 partially facing the conference participants. Any feedback from the loudspeakers 23 and 24 to the unit 10, if the loudspeakers 23 and 24 are operating in phase, would cancel in the unit 10 and produce minimal net feedback, given good symmetry.

Figure 6:
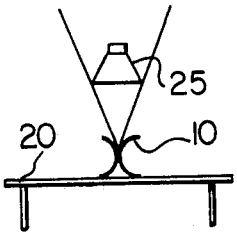
FIG. 6 shows an alternative arrangement for a microphone unit and a loudspeaker for conference purposes.

FIG. 6 shows a loudspeaker 25 suspended from a point above the unit 10, which is placed on the conference table 20. This arrangement gives good quality probably due to the treble frequencies from the loudspeaker 25 bouncing off the table 20 top to the participants on either side of the table 20.

Figure 7:
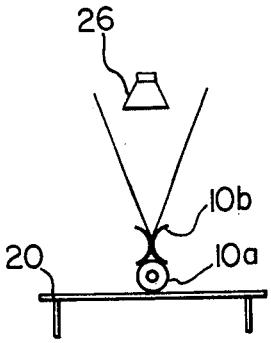
FIG. 7 shows an arrangement utilizing two orthogonal microphone units and a loudspeaker for conference purposes.
Figure 8:
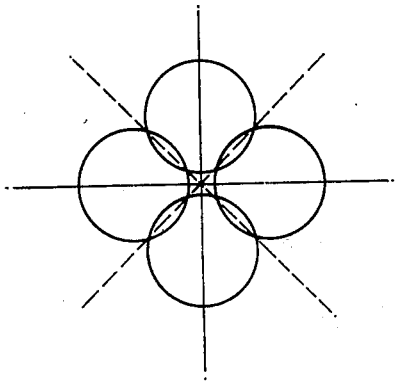
FIG. 8 is a plan view of the general directionality pattern of the two orthogonal microphone units shown in FIG. 7.

In FIG. 7 is shown an arrangement similar to that in FIG. 6, except that two microphone units 10*a* and 10*b* are placed on the table 20 top orthogonal to each other. This way, by summing the outputs from the units 10*a* and 10*b*, a quasi-toroidal pattern is obtained with its axis of symmetry vertical to table 20. This quasi-toroidal pattern is shown in a plan view in FIG. 8. The two axes of maximum sensitivity of the units 10*a* and 10*b* are perpendicular and parallel to the plane of the table 20. At 45° from either of these two axes, the output of each of the units 10*a* and 10*b* is 3 dB below maximum, but because the outputs of the units 10*a* and 10*b* are summed the total response of the combined units 10*a* and 10*b* is again maximum along the 45° directions. Thus, the pattern is close to being toroidal, and the total response or sensitivity is almost constant at any angle in the horizontal plane, dependent only on the distance from the units 10*a* and 10*b*. This is a desirable condition for conference applications.

The arrangement shown in FIG. 7 is particularly suitable for a conference room with a hard ceiling and sound-absorbing walls, whereby the sound level of the loudspeaker is enhanced, while acoustic feedback is reduced.

Figure 9:
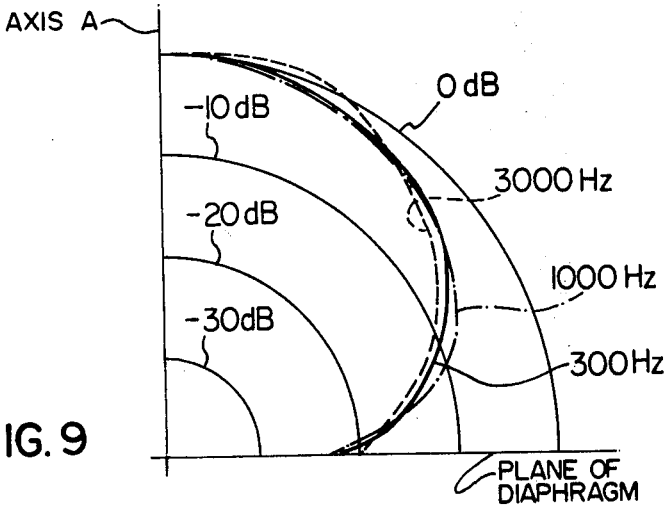
FIG. 9 shows a more detailed polar directionality pattern of a microphone unit in the plane of its axes.

FIG. 9 shows a typical response of a single microphone unit 10 in one quadrant of the plane of the axis A.

As may be seen, the response declines from its maximum (0dB) on the axis A to its minimum in the plane of the diaphragm of some −20dB. The important feature is the relative constancy of the response irrespective of frequency. The three plots at 300, 1000 and 3000 Hz are almost coincident, indicating the aforementioned independence of response quality from the talker's position.

What is claimed is:

1. A microphone unit comprising a bidirectional acousto-electric transducer of the cosine-response type disposed in proximity to, and between, two dish-like back-to-back sound collectors each having an aperture therein exposing one of two active, opposite surfaces of said acousto-electric transducer, whereby said microphone unit exhibits substantially rotational symmetry around a central axis of bidirectionality.

2. The microphone unit of claim 1, each of said two opposite surfaces of said acousto-electric transducer being within a therewith substantially coextensive aperture in the respective one of said two dish-like back-to-back sound collectors.

3. Two microphone units as claimed in claim 1, or 2, one having its axis of bidirectionality perpendicular to that of the other, and both having a common null-axis in the third spatial dimension.

4. The microphone unit of claim 1, or 2, said acousto-electric transducer being an electret microphone.

5. Two microphone units as claimed in claim 1, or 2, one having its axis of bidirectionality perpendicular to that of the other, and both having a common null-axis in the third spatial dimension, and the acousto-electric transducer in each of said two microphone units being an electret microphone having a single planar diaphragm perpendicular to the central axis of bidirectionality.

6. The microphone unit of claim 1 or 2, in combination with an electro-acoustic transducer disposed to substantially symmetrically intersect a null-plane of said microphone unit.

7. Two microphone units as claimed in claim 1 or 2, one having its axis of bidirectionality perpendicular to that of the other, and both having a common null-axis in the third spatial dimension, said common null-axis being the intersection of two null-planes of said two microphone units, in combination with an electro-acoustic transducer disposed substantially symmetrically along said common null-axis.

8. The microphone unit of claim 1 or 2, in combination with an electro-acoustic transducer disposed to substantially symmetrically intersect a null-plane, and said acousto-electric transducer being an electret microphone having a single planar diaphragm perpendicular to said central axis of bidirectionality.

9. Two microphone units as claimed in claim 1 or 2, one having its axis of bidirectionality perpendicular to that of the other, and both having a common null-axis in the third spatial dimension, said common null-axis being the intersection of two null-planes of said two microphone units, in combination with an electro-acoustic transducer disposed substantially symmetrically along said common null-axis, and the acousto-electric transducer being an electret microphone having a single planar diaphragm perpendicular to said central axis of bidirectionality.

* * * * *